United States Patent [19]

Kester, Jr.

[11] 3,974,732

[45] Aug. 17, 1976

[54] MULTIPLE MUSICAL INSTRUMENT HOLDER FOR MARCHING

[76] Inventor: Ralph C. Kester, Jr., 1531 20th Ave., Lakeworth, Fla. 33460

[22] Filed: Mar. 31, 1975

[21] Appl. No.: 563,576

[52] U.S. Cl. ..... 84/421; 224/5 S

[51] Int. Cl.[2] ..... G10D 13/02

[58] Field of Search ..... 224/5 R, 5 S, 25 R; 84/411, 421

[56] References Cited

UNITED STATES PATENTS

| | | | |
|---|---|---|---|
| 3,021,744 | 2/1962 | Kester | 84/421 |
| 3,106,123 | 10/1963 | Johannsen | 84/421 |
| 3,774,823 | 11/1973 | Hoellerich | 84/421 X |

*Primary Examiner*—John Gonzales
*Attorney, Agent, or Firm*—Hobbs & Green

[57] ABSTRACT

A multiple instrument holder for marching, in which a support section for holding a plurality of percussion instruments is supported in forwardly spaced relation to the body of the marcher by a means projecting forwardly from the marcher's body and engaging the instrument support section. Harness around the shoulders of the marcher is used for supporting the outer end of the projecting means and the instrument support section in various vertical positions. The instrument support section is preferably bar-like and arcuate in shape, and contains a plurality of means for holding instruments in various positions and arrangements thereon.

8 Claims, 10 Drawing Figures

Fig. 1
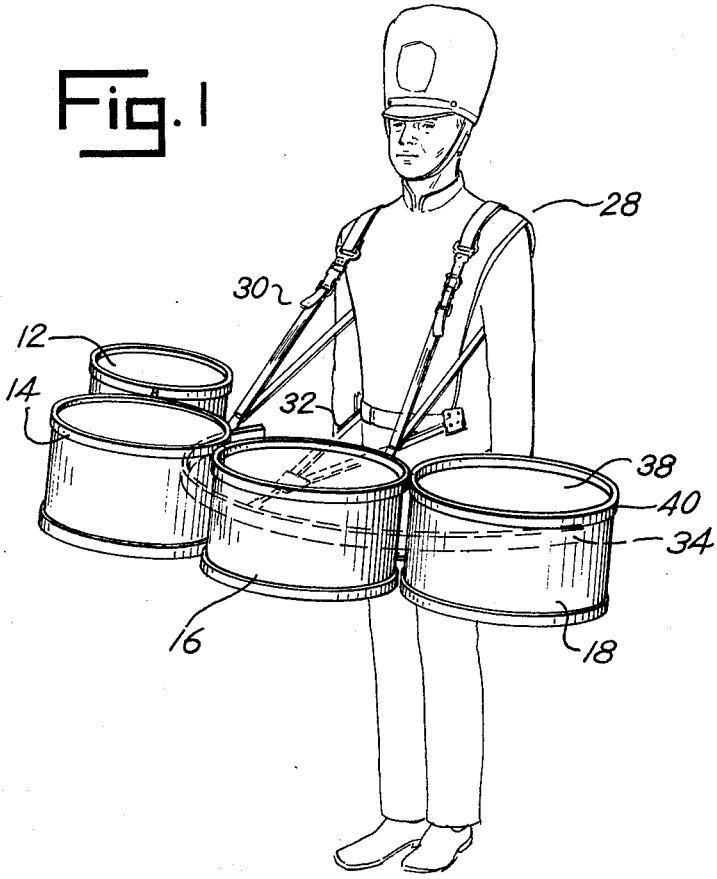
Fig. 2
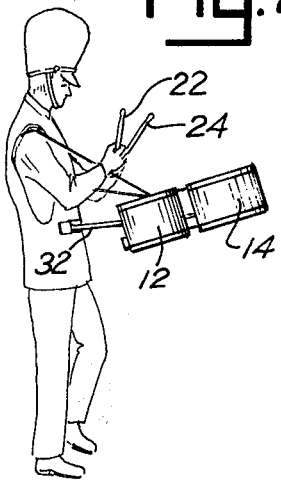
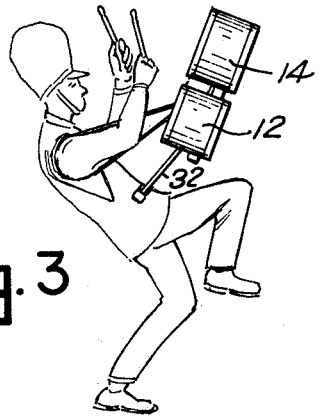
Fig. 3
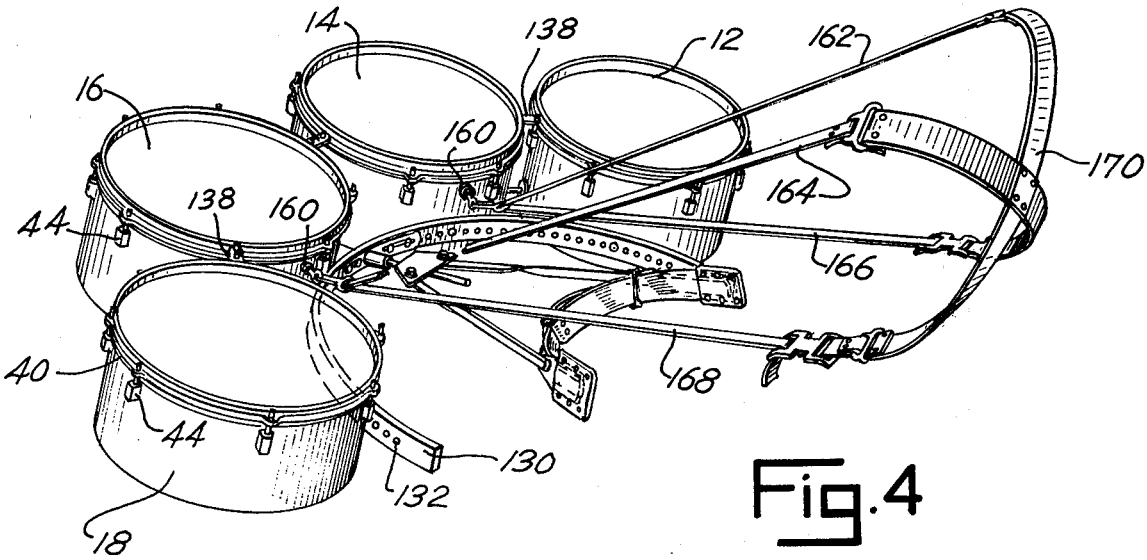
Fig. 4

MULTIPLE MUSICAL INSTRUMENT HOLDER FOR MARCHING

In marching bands the conventional practice of carrying drums and other percussion instruments is to strap the instrument to the body with straps over the shoulders and around the waist, and to permit the instrument to rest on or close to the body. This practice interferes with and restricts the marcher's movements, both in marching and in playing the instruments, and prevents the marcher from effectively playing more than one or two percussion instruments while marching. An important development was made in increasing the maneuverability and freedom of movement of the marcher by the invention of the drum holder disclosed and claimed in my U.S. Pat. No. 3,021,744, which holds the drum away from the marcher's body a distance sufficient to permit freedom of movement of the legs in marching, and holds the drum in a position in which it can easily be played while the drummer is either marching or standing. while this device was a major improvement over the prior drum holders, the holder disclosed in the patent is normally used with a single drum or other percussion instrument. It is therefore one of the principal objects of the present invention to provide a holder for a number of the same or different percussion instruments, which supports the instruments away from the body of a marcher in a band, and yet which places the various instruments in optimum position for playing while the player is either marching or standing.

Another object of the invention is to provide an implement which can be used in conjunction with the holder of my aforementioned patent to support a multiplicity of musical instruments in effective playing position for a marcher in a band, and which is so constructed and designed that a variety of different instruments can be supported in a variety of different arrangements.

Still another object of the invention is to provide a multiple musical instrument holder for percussion players of a marching band, which can support in playing position from one to six drums, for example, with other instruments and accessories, and which is used in such a manner with the apparatus of my aforementioned patent that the player can march, stand or sit, and effectively play all the instruments supported by the holder while marching, standing or sitting.

A further object is to provide a holder and/or apparatus of the aforementioned type which is simple in construction, versatile in its use, and attractive in appearance, and can easily be transported and stored when not in use, and which can easily be supported by a marcher from the shoulders and waist for prolonged periods of time without undue strain.

Additional objects and advantages of the present invention will become apparent from the following description and accompanying drawings, wherein:

FIG. 1 is a perspective view of a drummer carrying the present multiple musical instrument holder supporting four drums;

FIG. 2 is a side elevational view of the drummer shown in FIG. 1, illustrating one position in which the holder and drums may be used;

FIG. 3 is a side elevational view of the drummer illustrating a further manner in which the holder and drums may be used;

FIG. 4 is a perspective view of the present musical instrument holder seen in the preceding figures, showing the holder removed from the drummer and supporting the four drums;

Figure 10:
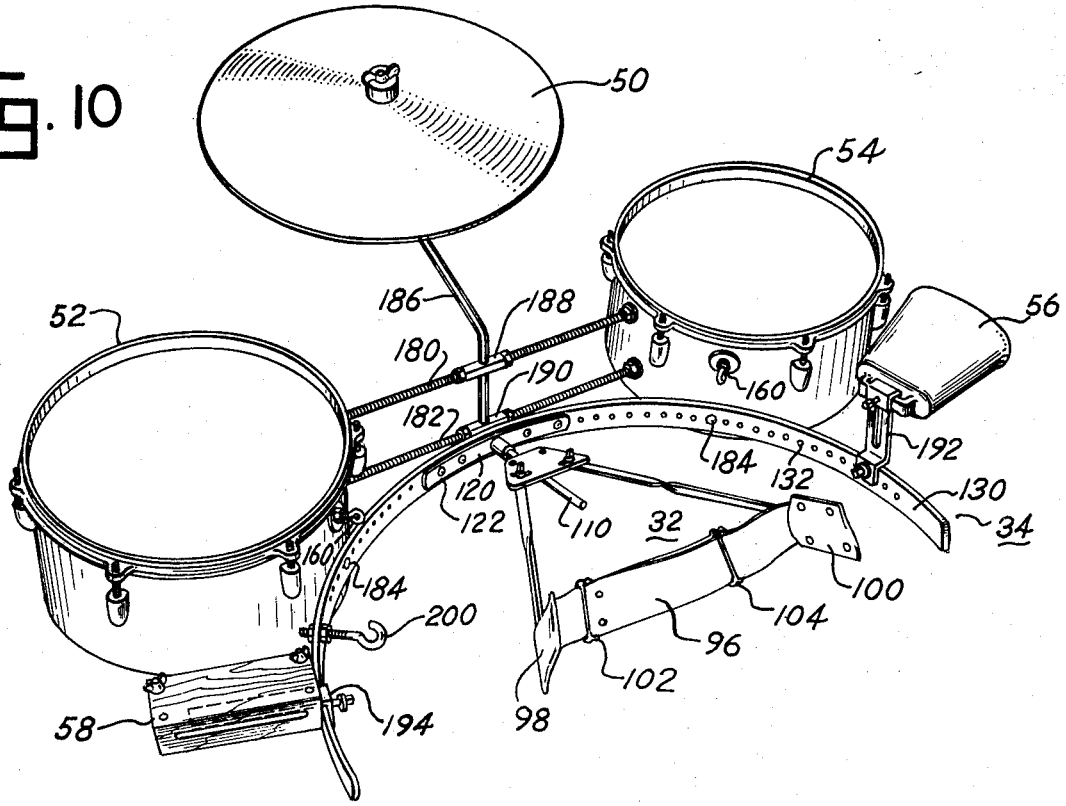
FIG. 10 is a perspective view of the present holder showing a different arrangement of percussion instruments mounted on the supporting section.
Figure 5:
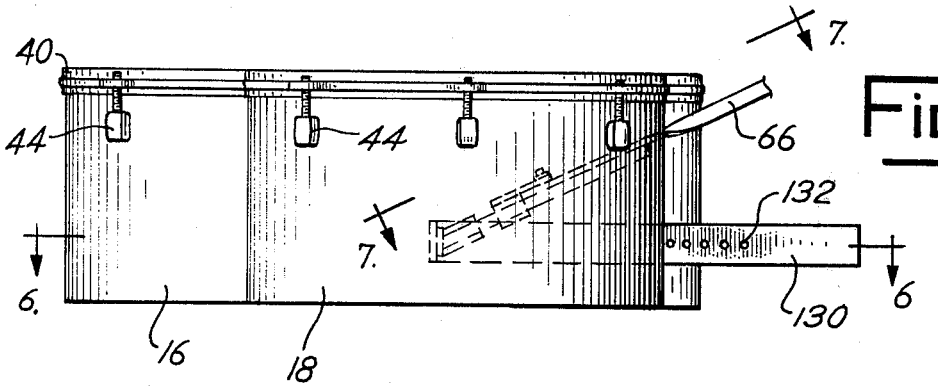
FIG. 5 is a side elevational view of the drums and multiple instrument holder with the holder removed from its supporting apparatus.
Figure 6:
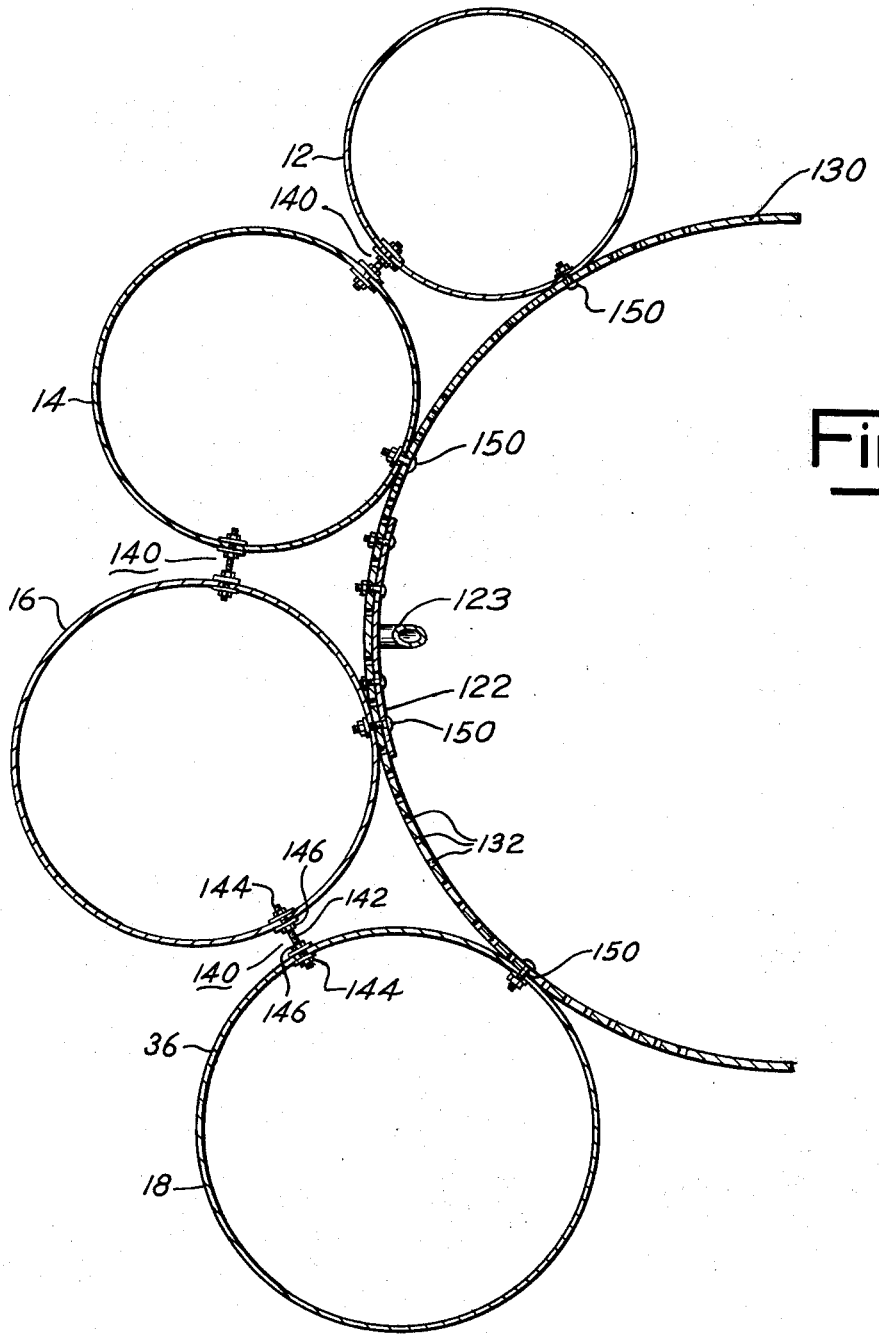
FIG. 6 is a horizontal cross sectional view through the drums and holder section seen in FIG. 5, the section being taken on line 6—6 of the latter figure.

Referring more specifically to the drawings, and to FIGS. 1, 2 and 3 in particular, numerals 12, 14, 16 and 18 designate conventional parade or tenor drums, numerals 22 and 24 refer to drum sticks held by the drummer 28, using shoulder harness indicated generally by numeral 30, the instrument holder 32, and instrument support section 34 to which the four drums are rigidly secured. The drum holder seats against the waist of the drummer and holds section 34 in spaced relation forwardly of the drummer's body. For the purpose of the present description, the drums are considered as conventional or standard parade or tenor drums, each including a body 36 and head 38, upper hoop 40 and tensioning means 44. While drums are shown in FIGS. 1 through 6, other instruments can be used advantageously on the present instrument support section, and FIG. 10 illustrates other instrument arrangements, including a cymbal 50, drums 52 and 54, cow bell 56 and a wood block 58. Various other instrument arrangements are possible and may be desirable in particular bands and from time to time in the bands, as will be more fully explained hereinafter.

Figure 7:
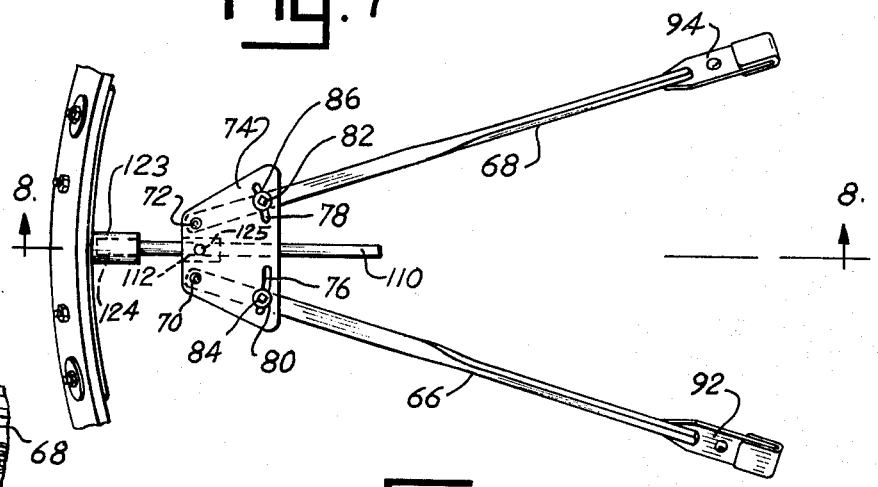
FIG. 7 is a fragmentary top plan view of the present musical instrument holder.
Figure 9:
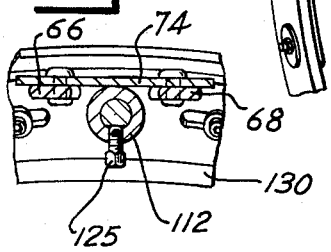
FIG. 9 is an enlarged fragmentary cross sectional view taken on line 9—9 of FIG. 8.
Figure 8:
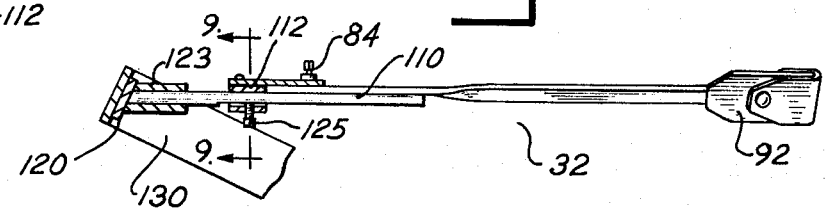
FIG. 8 is a horizontal cross sectional view taken on line 8—8 of FIG. 7.

The drum holder assembly 32, shown clearly in FIG. 7 and disclosed in my prior patent, and illustrated herein as an example of one suitable structure, consists of two rods 66 and 68 supported at their forward end by rivets 70 and 72 extending through the rods and through the forward end of a rigid metal plate 74, the rods preferably being constructed of steel or aluminum flat or round stock. To permit lateral adjustment of the rods and to hold the rods in their adjusted position, arcuate slots 76 and 78 are provided in plate 74 near the rear edge thereof, and threaded square headed flange screws 80 and 82 extend through rods 66 and 68 and slots 76 and 78, respectively, for clamping the rods against the plate after an adjustment has been made.

The rear ends of the rods are provided with a flat, rather broad portion 92 and 94, and are supported by a half belt 96 having pockets 98 and 100 for receiving ends 92 and 94. The half belt is preferably of web material, and includes a suitable adjustment means, such as slide fasteners 102 and 104 for adjusting the length of the half belt to fit any drummer. In the belt shown, the pockets at each end are formed by turning the ends of the material toward the center and stitching or riveting the edges of the overlapping ends to the body portion. However, the construction and shape of the means for supporting the rear ends of rods 66 and 68 are not considered an important feature of the present invention.

The structure for attaching the forward end of the holder to the instrument support section 34 consists of a rod 110 slidably mounted in a sleeve 112 secured to the underside of plate 74, and a fixture 120 having a bar 122 and a lug 123 with a hole 124 therein for receiving the forward end of rod 110. Rod 110 is held in its longitudinally adjusted position by a set screw 125 extending through a hole in sleeve 112.

The instrument support section 34, as shown in the drawings, consists of an arcuate member 130, preferably of aluminum, having a series of holes 132 for receiving fastening means such as screws or bolts for attaching various instruments to the member 130. Member 130 is secured to fixture 120 by screws or rivets or other suitable securing means, so that the two are rigidly connected to one another and to lug 123. In the preferred form, member 130 is essentially a semicircle extending approximately 180° in front of the marcher; however, it may be of a somewhat different configuration, depending upon the type of instruments to be carried thereby. Nevertheless, it is normally essential that the outer ends extend generally rearwardly to permit the instruments mounted thereon to be reached as easily and effectively as the instruments directly in front of the marcher. Member 130 contains holes 132 throughout substantially its full length so that the instruments can be placed at various desired positions along member 130, as well as providing holes for receiving mounting fixtures for a number of different instruments. Member 130 is substantially rigid, and while it could be reshaped within limits, it normally remains in the predetermined configuration, such as that illustrated in the drawings. While drum holder assembly 32 is shown, wherein the arcuate member is supported at the center, other types may be used, including one in which the side rods are more or less parallel and are attached to member 130 in spaced relation to one another. Various other changes are possible and may be desirable for some uses of member 130.

In the use and operation of the present multiple instrument holder, four drums may be mounted in the manner illustrated in FIGS. 1 through 6, in which the drums are connected at the top to one another by upper links 138 and at the lower part of the sides by fixtures or lower links 140, the latter consisting of a threaded shaft 142 having two nuts 144 and 146 on each end thereof for clamping the sides of the adjacent drums firmly in place on the shaft, holding the two drums firmly in fixed relation to one another. Each of the four drums is connected to member 130 by a screw 150 extending through a hole in the side of the drum and through one of holes 132, thus securing the drums to member 130. With the drums mounted in the foregoing manner, the holder, indicated generally by numeral 32, and having belt 96 in adjusted position, is placed at the waist of the marcher, and straps, indicated generally by numeral 30, are attached to the two eyes or hooks 160 in drums 14 and 16. The upper straps 162 and 164 and lower straps 166 and 168, which are connected to eyes 160, are adjustable so that the harness 170 extending over the shoulders of the marcher will hold the instrument at the desired level, such as that illustrated in FIGS. 1 and 2, so that the instruments can easily and effectively be played by the player while marching, standing or sitting. The four straps 162, 164, 166 and 168 may be connected to anchors or screws located in different positions, either on the drums or other musical instruments, or on member 130, so long as the straps provide firm support for the instruments and the section 34, without interfering with the movement of the marcher's arms in playing the instruments.

FIG. 10 is included to illustrate the versatility of musical instrument holder 34. In this arrangement, two drums 52 and 54 are rigidly connected together by rods 180 and 182, with nuts on opposite ends thereof securing the side walls of the drums to the ends of the threaded rods. The lower shaft is secured to member 130 by a screw or bolt which holds the drums in rigid position, and the two drums are secured to member 130 by screws 184. The cymbal 50 is supported on a shaft 186 which extends downwardly through holes in connectors 188 and 190 on threaded shafts 180 and 182, and the cow bell 56 is supported by a fixture 192 which in turn is connected to member 130, and wood block 58 is secured to member 130 by a fixture 194. To further illustrate the versatility of the present musical instrument holder, an accessory item hook 200 is shown connected to member 130. A number of these accessory hooks may be used to hold various instruments, such as a triangle, or tambourine, a small xylophone, bell lyra, set of conventional bells, bongos, timbales, congos and other percussion accessories, which may be held, attached and carried thereon. Further, a music lyre may be attached to rod 110 or on arcuate member 130. The hook may be covered by a plastic or rubber layer or tube to permit the instrument to have direct contact therewith, without interfering with the tone of the instrument if played while held by the hook.

The present musical instrument holder is not only versatile with respect to the types and number of instruments which can be effectively carried and played while the player is marching, standing or sitting, but also is so constructed and designed that the marcher can remove the holder and disassemble it into subassemblies for transportation and storage, without removing the instruments from member 130. However, the instruments can be readily removed from member 130 if a change is to be made in the combination of instruments supported thereby.

While only one embodiment of the present multiple instrument holder has been described in detail herein, various changes and modifications may be made without departing from the scope of the invention.

I claim:

1. A multiple musical instrument holder for marching, comprising an instrument support section including an elongated, horizontally disposed member having the outer ends thereof extending rearwardly and having a plurality of laterally spaced instrument support stations for holding a plurality of percussion instruments in playing position, a forwardly projecting means connected at its forward end to said instrument support section and extending to a position for engagement with the body of the marcher near the waist for holding the instrument support section in forwardly spaced relation to the marcher's body, and shoulder harness for the marcher for supporting the forward end of said projecting means and the instrument support section in a desired position relative to the body of the marcher.

2. a multiple musical instrument holder as defined in claim 1 in which said instrument support section consists of a bar-like member in a generally arcuate shape with the outer ends thereof extending rearwardly.

3. a multiple musical instrument holder as defined in claim 2 in which said bar-like section contains a plurality of holes spaced therealong for holding fixtures for the musical instruments in rigid position on said section at and in various positions.

4. A multiple musical instrument holder as defined in claim 3 in which said forwardly projecting means is extendible and contractable for adjusting the position of said instrument support section in various positions relative to the body of the marcher.

5. A multiple musical instrument holder as defined in claim 1 in which said instrument support section is an elongated bar-like member having a plurality of holes spaced therealong for holding fixtures for the musical instruments in playing position on said section at and in various positions.

6. A multiple musical instrument holder as defined in claim 1 in which said forwardly projecting means is extendible and contractable for adjusting the position of said instrument support section in various positions relative to the body of the marcher.

7. In an instrument holder for marching, an instrument support section including an elongated, horizontally disposed member having the outer ends thereof extending rearwardly and having a plurality of laterally spaced instrument support stations for holding a plurality of percussion instruments, said section having means for attaching instruments thereto and a means for supporting said section in forwardly spaced relation with respect to the body of the marcher.

8. A multiple musical instrument holder as defined in claim 7 in which said instrument support section is of a bar-like arcuate construction having the ends thereof extending generally rearwardly.

* * * * *